US008256477B2

(12) United States Patent
Welsh et al.

(10) Patent No.: US 8,256,477 B2
(45) **Date of Patent: *Sep. 4, 2012**

(54) PORTABLE WORK BENCH

(75) Inventors: Robert P. Welsh, Hunt Valley, MD (US); Thomas R. Sommerville, Port Perry (CA)

(73) Assignee: Black & Decker Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/008,188

(22) Filed: Jan. 18, 2011

(65) Prior Publication Data

US 2012/0018044 A1 Jan. 26, 2012

Related U.S. Application Data

(63) Continuation of application No. 12/342,479, filed on Dec. 23, 2008, now Pat. No. 7,891,389, which is a continuation of application No. 11/368,113, filed on Mar. 3, 2006, now Pat. No. 7,481,254, which is a continuation of application No. 10/830,278, filed on Apr. 22, 2004, now Pat. No. 7,036,540, which is a continuation of application No. 10/187,736, filed on Jul. 2, 2002, now Pat. No. 6,745,804.

(60) Provisional application No. 60/304,556, filed on Jul. 11, 2001.

(51) Int. Cl.
*B25H 1/00* (2006.01)

(52) U.S. Cl. ..... 144/286.1; 144/286.5; 144/287

(58) Field of Classification Search ..... 144/286.1, 144/286.5, 287
See application file for complete search history.

(56) References Cited

U.S. PATENT DOCUMENTS

| | | | | |
|---|---|---|---|---|
| 5,592,981 | A * | 1/1997 | Derecktor | 144/286.1 |
| 5,836,365 | A * | 11/1998 | Derecktor | 144/287 |
| 5,868,185 | A * | 2/1999 | Poling et al. | 144/286.5 |
| 5,875,828 | A * | 3/1999 | Quiram et al. | 144/329 |
| 5,988,243 | A * | 11/1999 | Ayala et al. | 144/329 |
| 6,199,608 | B1 * | 3/2001 | Ayala et al. | 144/286.1 |
| 6,415,831 | B2 * | 7/2002 | Ayala et al. | 144/286.1 |
| 6,745,804 | B2 * | 6/2004 | Welsh et al. | 144/287 |
| 7,036,540 | B2 * | 5/2006 | Welsh et al. | 144/286.1 |
| 7,481,254 | B2 * | 1/2009 | Welsh et al. | 144/286.1 |
| 7,891,389 | B2 * | 2/2011 | Welsh et al. | 144/286.1 |

* cited by examiner

*Primary Examiner* — Bena Miller
(74) *Attorney, Agent, or Firm* — Adan Ayala

(57) ABSTRACT

An improved portable work bench includes a beam, legs for supporting the beam, and at least one bracket having first and second surfaces for contacting respective first and second sides of the beam, wherein the second surface is movable between a first position contacting the second side of the beam, and a second position not contacting the second side of the beam. A spring biases the second surface towards the first position.

13 Claims, 13 Drawing Sheets

PORTABLE WORK BENCH

CROSS-REFERENCE TO RELATED APPLICATIONS

The following application is a continuation of U.S. patent application Ser. No. 12,342,479, filed on Dec. 23, 2008, now U.S. Pat. No. 7,891,389, which is a continuation of U.S. patent application Ser. No. 11/368,113, filed on Mar. 3, 2006, now U.S. Pat. No. 7,481,254, which is a continuation of U.S. patent application Ser. No. 10/830,278, filed Apr. 22, 2004, now U.S. Pat. No. 7,036,540, which is a continuation of U.S. patent application Ser. No. 10/187,736, filed Jul. 2, 2002, now U.S. Pat. No. 6,745,804, which in turn derives priority under 35 USC §119(e) from U.S. Application No. 60/304,556, filed Jul. 11, 2001.

FIELD OF THE INVENTION

This invention relates generally to work benches and more particularly to a portable work bench that can support a power tool and a workpiece.

BACKGROUND OF THE INVENTION

It is common in the construction industry for users to bring their power tools to the work site. Thus, the users require a work surface at the work site to support the power tools for use. Preferably the work surface is at a certain height so that the user can comfortably use the power tool. In addition, the work surface should also be sufficiently portable to be easily moved around a work site.

In the past, users have disposed their power tools on sheets of wood which are in turn supported by two or more sawhorses. This arrangement, however, lacks the strength and stability for efficient operation, as well as being difficult to set up and move around the work site.

Accordingly, different support stands or work benches have been proposed in order to provide a portable work surface that can support a power tool. Some of these prior art solutions have been described in U.S. Pat. Nos. 1,864,840, 4,860,807, 4,874,025, 4,974,651, 5,193,598, and 5,421,231. However, these prior art solutions do not provide a platform supporting the power tool which can be moved horizontally so that the power tool can be moved without moving the workpiece.

Other prior art solutions, such as the one described in U.S. Pat. No. 5,592,981, provide a platform supporting the power tool which can be moved horizontally so that the power tool can be moved without moving the workpiece. However, they require that the user insert and slide the platform from the end of the workbench towards the desired position on the workbench.

SUMMARY OF THE INVENTION

In accordance with the present invention, an improved portable work bench is employed. The workbench may include a beam, legs for supporting the beam, and at least one bracket having first and second surfaces for contacting respective first and second sides of the beam, wherein the second surface is movable between a first position contacting the second side of the beam, and a second position not contacting the second side of the beam.

Additional features and benefits of the present invention are described, and will be apparent from, the accompanying drawings and the detailed description below.

BRIEF DESCRIPTION OF THE DRAWINGS

The accompanying drawings illustrate preferred embodiments of the invention according to the practical application of the principles thereof, and in which:

FIG. 17 illustrates a second embodiment of an extension arm lock assembly, where

FIG. 20 illustrates a workpiece support assembly, where

DETAILED DESCRIPTION

Figure 1:
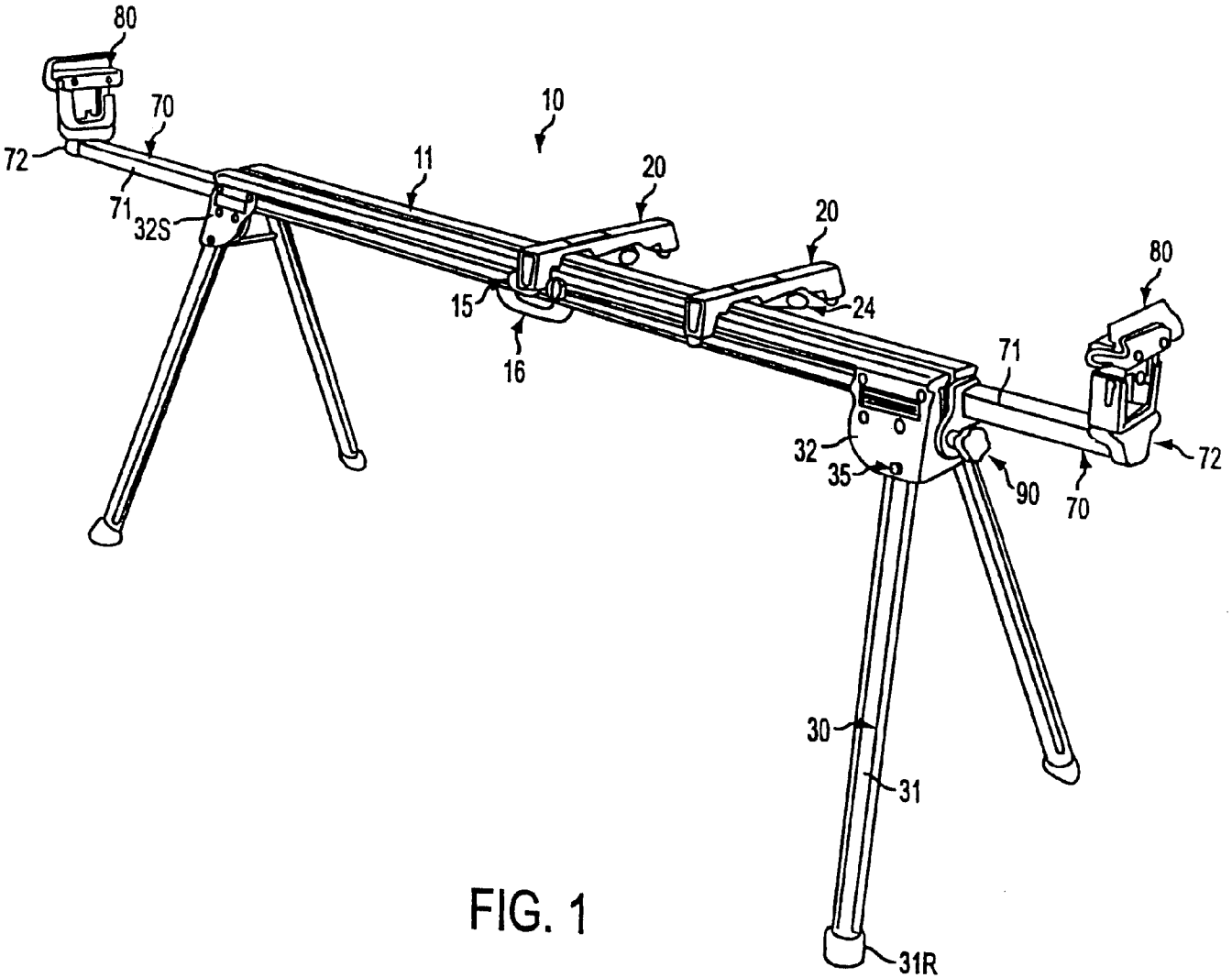
FIG. 1 is a perspective view of a portable work bench of the present invention.
Figure 8:
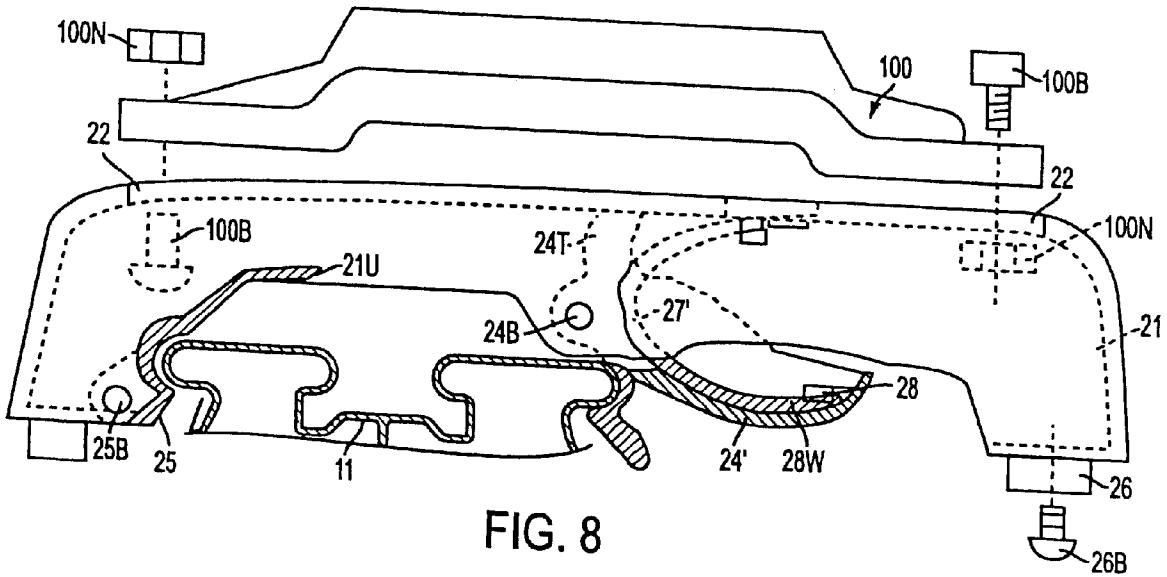
FIG. 8 is a partial cross-sectional view of a second embodiment of the mounting bracket of FIG. 5.
Figure 10:
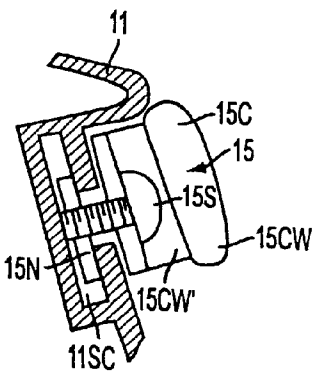
FIG. 10 is a cross-sectional view along line X-X of FIG. 9.
Figure 9:
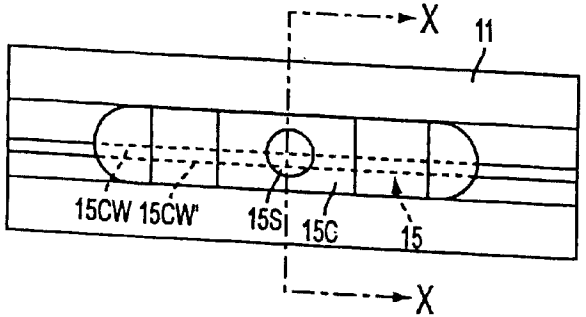
FIG. 9 is a close-up view of the area IX of FIG. 2.

The invention is now described with reference to the accompanying figures, wherein like numerals designate like parts. Referring to FIGS. 1 and 8, a portable work bench 10 of the present invention is designed to carry a chop saw 100 and/or a workpiece (not shown). However, persons skilled in the art will recognize that the work bench 10 can support any power tool, such as a sliding compound miter saw, a drill press, a table saw, etc., any hand tools, or anything else that may need to be supported.

The work bench 10 has a structural body 11 and at least one mounting bracket 20 disposed on the structural body 11. Preferably, the structural body 11 supports two mounting brackets 20.

Figure 3:
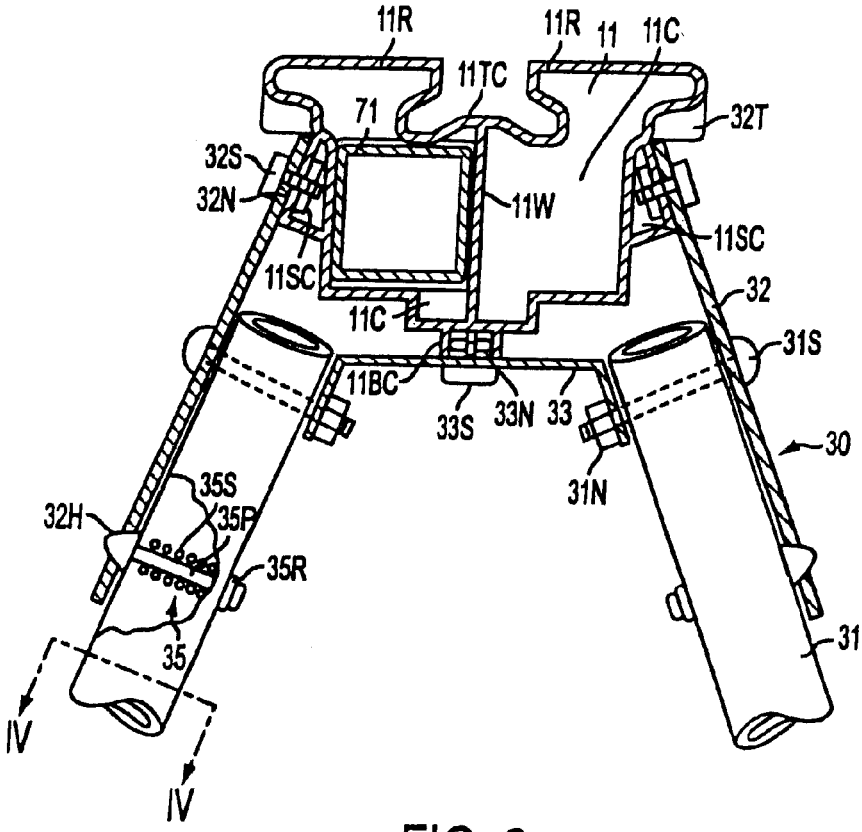
FIG. 3 is a cross-sectional view of the work bench along line of FIG. 2.

Referring to FIG. 3, the structural body 11 is preferably elongated and tubular, and may have a thin wall which substantially defines the outer perimeter thereof. Such body 11 can withstand substantial amounts of torsional and lateral loads applied thereto. Body 11 can be made of extruded aluminum, bent metal, fabricated sheet metal, etc.

Body 11 may have rails 11R and/or channels 11TC, 11SC, 11BC to connect elements thereto, as explained below. In addition, body 11 may have two chambers 11C for wholly or partially receiving extension arm assemblies 70, as discussed below. Body 11 may also have a central wall 11W to divide the chambers 11C and/or increase the rigidity of body 11.

In addition, the work bench 10 may have leg assemblies 30 for supporting the structural body 11 and mounting brackets 20 (and thus the chop saw 100 and/or workpiece). Referring to FIGS. 1-4, the leg assemblies 30 may include a leg 31 pivotally connected to the body 11 via brackets 32, 33.

Figure 4:
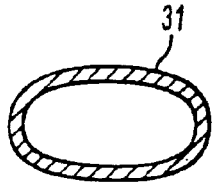
FIG. 4 is a cross-sectional view along line IV-IV of FIG. 3.
Figure 5:
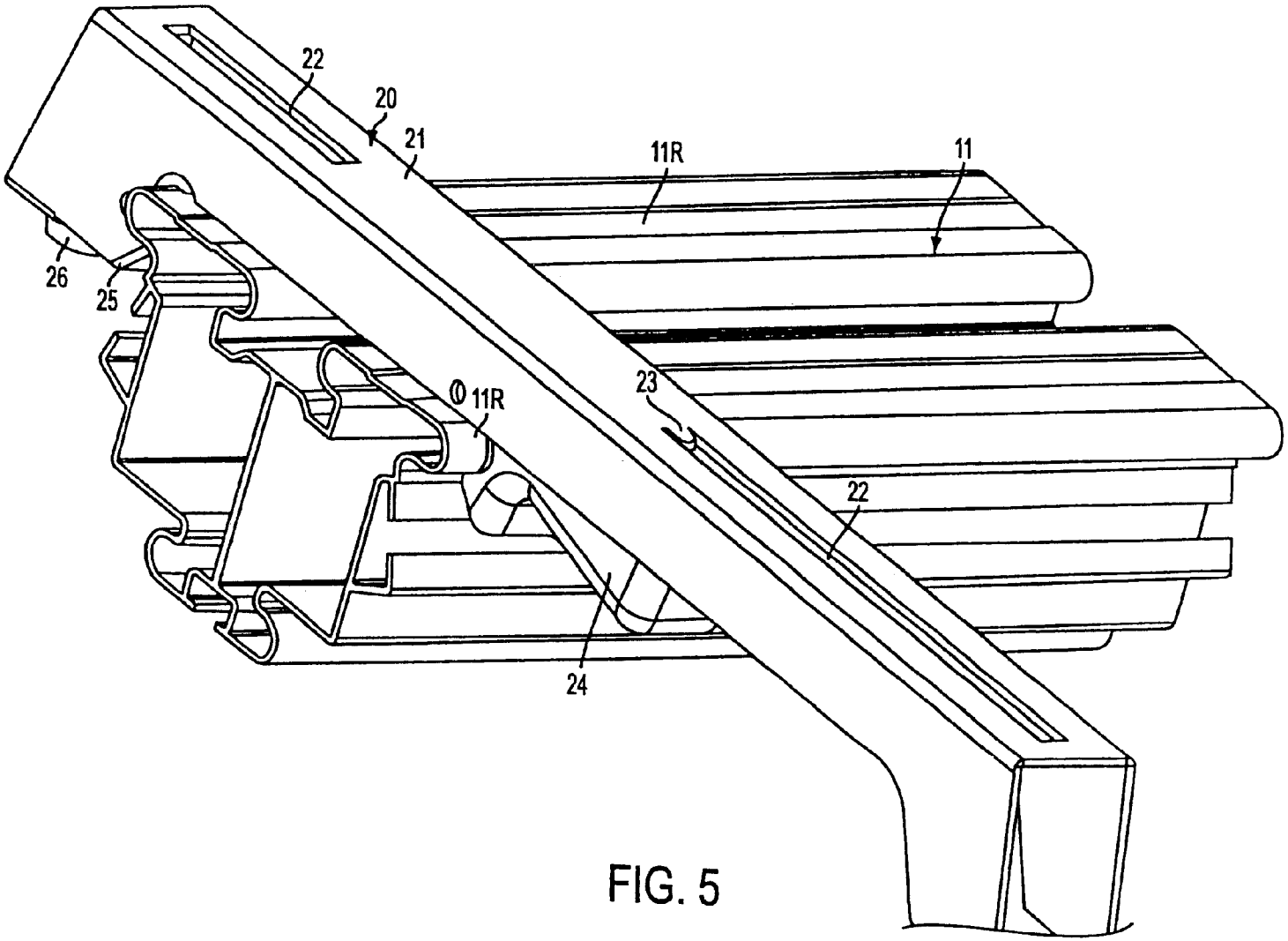
FIG. 5 is a top perspective view of a mounting bracket according to the present invention.
Figure 6:
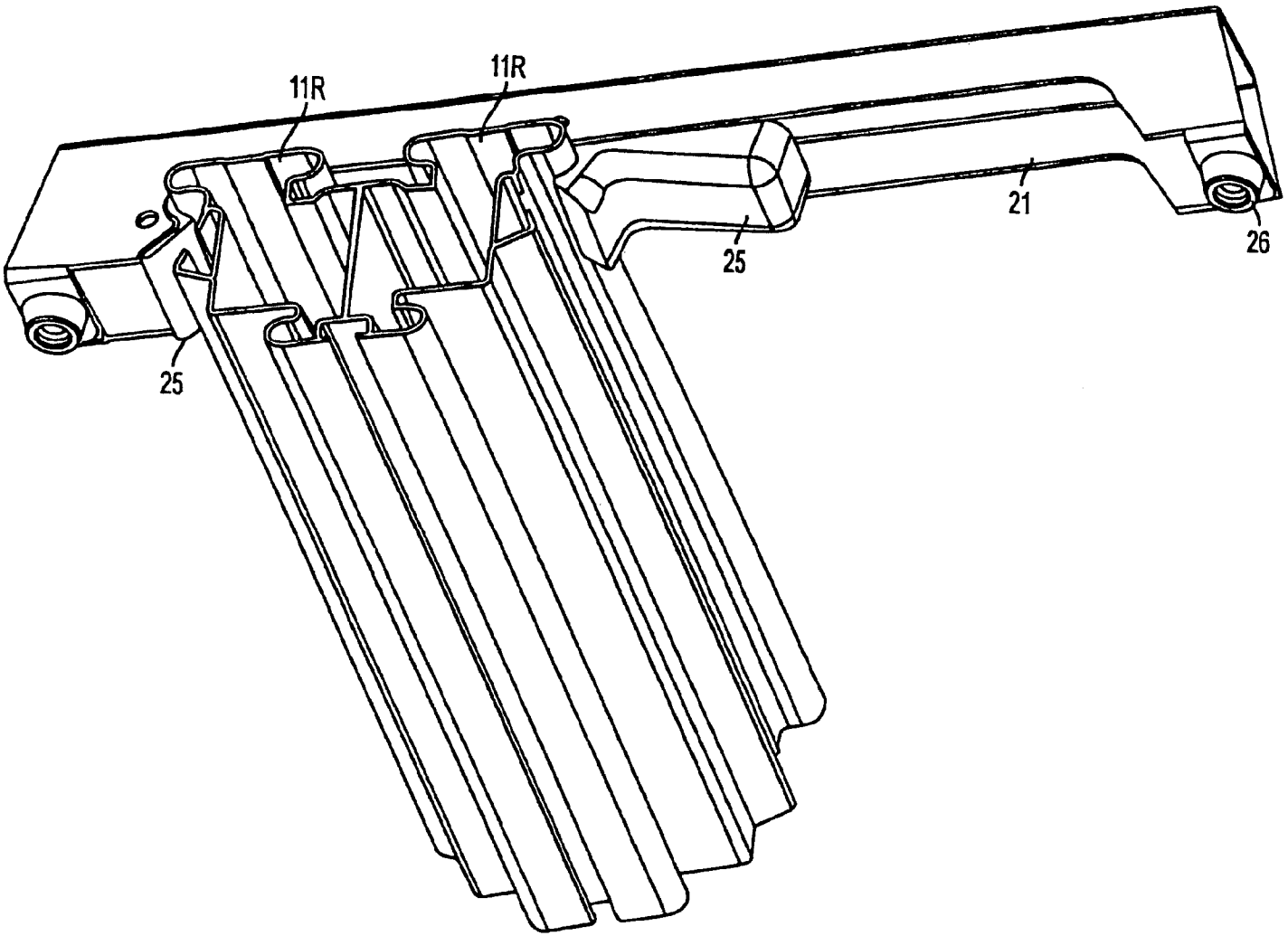
FIG. 6 is a bottom perspective view of the first embodiment of FIG. 5.

Preferably, leg 31 is made of metal, such as extruded aluminum. The cross-section of leg 31 may be round or ob-round (with two opposing substantially flat sides), such as shown in FIG. 4.

Leg 31 may have an end 31R, which may be made of an elastomeric material, a plastic or rubber. Preferably, the end 31R is made of a material that prevents slippage of the leg 31 along a floor or other supporting surface.

Bracket 32 may wrap around the end of body 11. Preferably, bracket 32 is made of metal, such as sheet steel. Bracket 32 may also be shaped so that it matches the upper profile of body 11. Preferably, bracket 32 is attached to body 11 via screws 32S, which may extend through bracket 32 and into channels 11SC of body 11, and threadingly engage nuts 32N disposed in channels 11SC. Persons skilled in the art should recognize that screws 32S may be disposed in channels 11SC, extend through bracket 32 and threadingly engage nuts 32N disposed on bracket 32. Persons skilled in the art should also recognize that washers may be provided between screws 32S, bracket 32, body 11 and nuts 32N as necessary.

Similarly, bracket 33 may be made of metal, such as sheet steel. Preferably, bracket 32 is attached to body 11 via screws 33S, which may extend through bracket 33 and into channel 11BC of body 11, and threadingly engage nuts 33N disposed in channels 11SC. Persons skilled in the art should recognize that screws 33S may be disposed in channels 11BC, extend through bracket 33 and threadingly engage nuts 33N disposed on bracket 33. Persons skilled in the art should also recognize that washers may be provided between screws 33S, bracket 33, body 11 and nuts 33N as necessary.

As mentioned above, leg 31 may be pivotally connected to brackets 32, 33 via screws 31S, which may extend through bracket 32, leg 31 and bracket 33, and threadingly engage nuts 31N disposed on bracket 33, or vice versa. Persons skilled in the art should also recognize that washers may be provided between screws 31S, brackets 32, 33, leg 31 and nuts 31N as necessary.

It is preferable to provide leg assembly 30 with a detent mechanism 35 to maintain the leg 31 in predetermined positions. Different detent mechanisms 35 may be found in U.S. Pat. Nos. 4,605,099 and 5,592,981, which are hereby incorporated by reference. Preferably, detent mechanism 35 includes a detent pin 35P, which engages a hole 32H in bracket 32. Detent pin 35P may be spring-biased towards engagement with hole 32H via a spring 35S. A retainer 35R, such as a C- or E-clip, may be disposed between pin 35P and leg 31, to prevent escape of the pin 35P. Persons skilled in the art should recognize that the pin 35P and hole 32H may be disposed alternatively on bracket 32 and leg 31, respectively.

Referring to FIGS. 1 and 5-8, a power tool 100 may be mounted to workbench 10 via mounting brackets 20. Mounting brackets 20 may mount onto beam 11. Preferably, the mounting brackets 20 engage the top and/or outside of rails 11R. Alternatively, the mounting brackets 20 could engage the insides of rails 11R, i.e., channel 11TC.

Mounting bracket 20 may have a body 21, which may be made of a metal, such as extruded aluminum, sheet steel, etc. Body 21 may have slots 22 for mounting the power tool 100. As shown in FIG. 8, the power tool 100 may be mounted onto body 21 with nuts 100N and bolts 100B. Bolt 100B may extend upwardly through slot 22 and through a hole in power tool 100, and threadingly engage nut 100N. Alternatively, bolt 100B may extend downwardly through a hole in power tool 100 and slot 22, and threadingly engage nut 100N.

Referring to FIGS. 5-8, mounting bracket 20 preferably engages rails 11R between a glide strip 25 and a lever 24. Preferably, both the glide strip 25 and the lever 24 are made of plastic, such as nylon. Glide strip 25 is preferably attached to body 21 via a bolt 25B, and an undercut 21U. On the other hand, lever 24 is pivotally attached to body 21 via a bolt 24B, or a boss.

Figure 7:
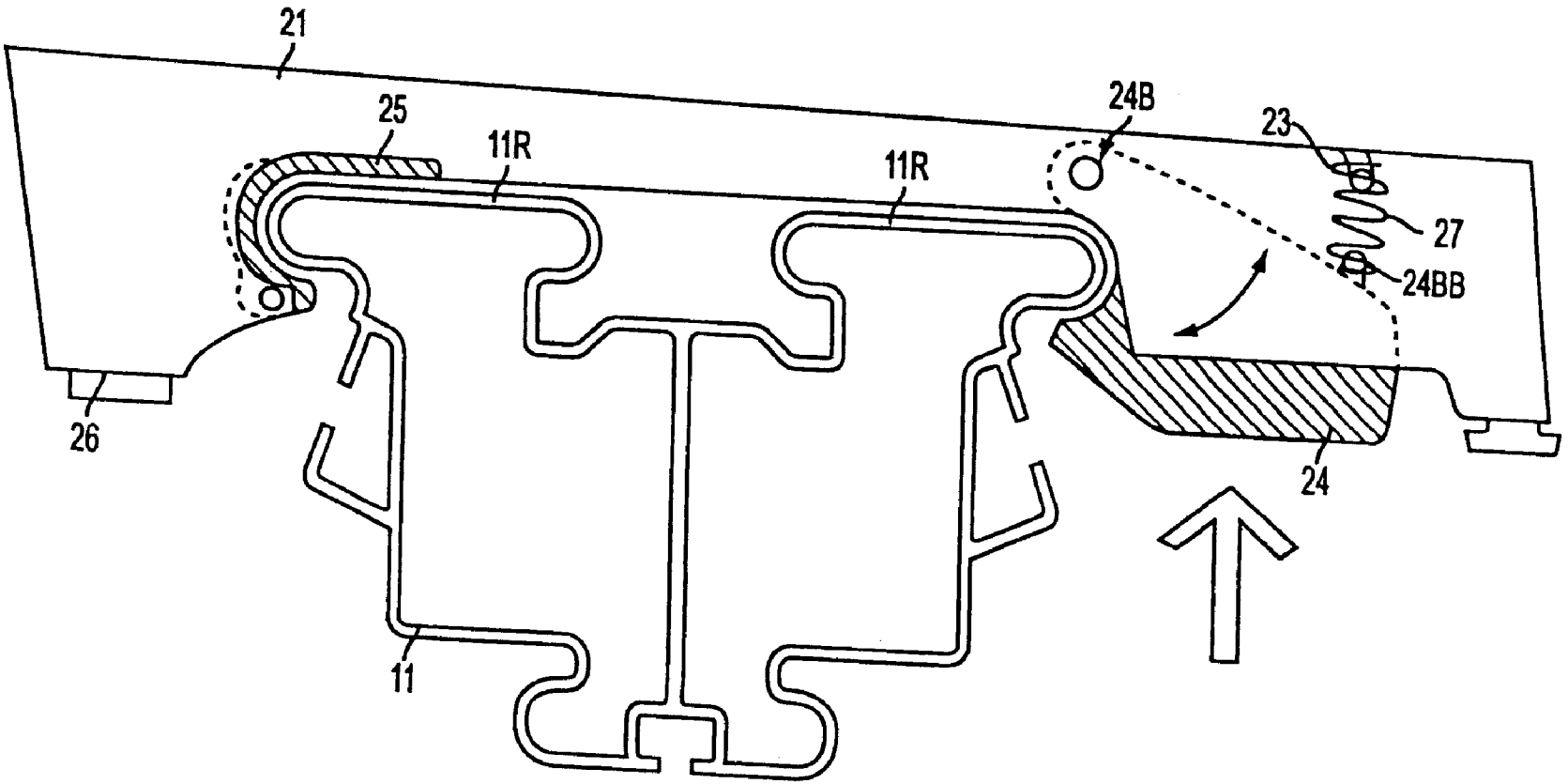
FIG. 7 is a partial cross-sectional view of a first embodiment of the mounting bracket of FIG. 5.

Preferably, lever 24 is biased towards contact with rail 11R. This may be achieved with a spring 27, 27'. Referring to FIG. 7, a spring 27 may be captured between a bent tab 23 and a lever boss 24BB. Alternatively, a leaf spring 27' may be captured by a bolt 28 and washer 28W threadingly engaging the lever 24' (see FIG. 8). Spring 27' may be fixed or riveted to body 21 at the other end. Alternatively, if the bend on spring 27' is deep enough, the upper end of spring 27' may stay in place without requiring any fixing means.

With such construction, the user can easily dispose the power tool 100 on beam 11. All the user needs to do is pull on levers 24, and put mounting brackets 20 (and power tool 100) on beam 11. To remove the power tool 100 from beam 11, the user needs only to pull on levers 24, and lift mounting brackets 20 (and power tool 100) from beam 11.

Persons skilled in the art should recognize that such arrangement can be tuned by the manufacturer between a slidable bracket 20 or a locking bracket 20. In other words, by changing the strength of spring 27, 27', the shape of lever 24, 24', the composition of glide strip 25 and/or lever 24,24', etc., the manufacturer can "program" the bracket 20.

For example, if the user desires a mounting bracket that locks onto beam 11 so that it cannot be pushed along beam 11 unless a large force parallel to the longitudinal axis of beam 11 is provided onto bracket 20 and/or power tool 100, the manufacturer can use a stronger spring 27, 27'. Alternatively, the manufacturer can change the shape of lever 24, 24' so that tab 24T (FIG. 8) does not contact body 21, allowing lever 24 to contact beam 11 with full spring force. Furthermore, the manufacturer can change the composition of glide strip 25 and/or lever 24, 24' so that they are "grippier" and less prone to sliding. Accordingly, the user can slide the mounting brackets 20 (and thus power tool 100) only when the user pivots levers 24. When the user releases levers 24, however, the mounting brackets 20 in effect lock in place.

On the other hand, if the user desires a mounting bracket that does not lock onto beam 11 so that it can be pushed along beam 11 with a small force parallel to the longitudinal axis of beam 11 provided onto bracket 20 and/or power tool 100, the manufacturer can use a weaker spring 27, 27'. Alternatively, the manufacturer can change the shape of lever 24, 24' so that tab 24T (FIG. 8) contacts body 21, preventing lever 24 to contact beam 11 with full spring force. Furthermore, the manufacturer can change the composition of glide strip 25 and/or lever 24, 24' so that they are more slippery and more prone to sliding. Accordingly, the user can slide the mounting brackets 20 (and thus power tool 100) longitudinally at any time.

With such arrangement, if the user wants to lock the mounting brackets 20 in place, a locating mechanism 15 is required. Referring to FIGS. 1-2 and 9-10, locating mechanism 15 may include a clip 15C, which is preferably made of metal, such as sheet steel, or plastic. The clip 15C may be held in place by a screw 15S, which may extend through clip 15C and into channel 11SC, and threadingly engage a nut 15N. Persons skilled in the art should recognize that the head of screw 15S may be disposed within channel 11SC, so that the screw 15S extends outwardly through clip 15C and threadingly engage nut 15N.

Clip 15C may have wings 15CW extending therefrom. Preferably, wings 15CW extend from both sides of clip 15C. Accordingly, a user can locate bracket 20 on clip 15C by disposing bracket 20 between the two wings 15CW. Wings 15CW may be inclined at an acute angle from the longitudinal axis of beam 11. Intermediate wings 15CW' may also be disposed between clip 15C and wings 15CW. Intermediate wings 15CW' may be disposed at an angle steeper than the acute angle of wings 15CW. Preferably, intermediate wings 15CW' are substantially perpendicular to the longitudinal axis of beam 11, whereas wings 15CW may be inclined at an angle of about 45°. Having such difference in angles may assist the user in locating clip 15C with bracket 20.

Preferably, the distance between intermediate wings 15CW' is about or larger than the width of bracket 20. Accordingly, if a bracket 20 is disposed on clip 15C between intermediate wings 15CW', the bracket 20 will have a small range of movement. Therefore, the bracket 20 is effectively limited in travel.

With such construction, a power tool 100 may be slidably disposed at any position on beam 11. However, the movement of power tool 100 (and mounting brackets 20) will be limited only when one bracket 20 is disposed on a clip 15C.

Persons skilled in the art will recognize the screw 15S is preferably covered by bracket 20 when bracket 20 is installed on clip 15C.

Brackets 20 may also have feet 26 attached thereto, so that, when power tool 100 and brackets 20 are removed from beam 11, the user can disposed the power tool 100 and brackets 20 on a surface for further cutting, etc. Feet 26 may be made of rubber or other elastomeric material. In addition, feet 26 may be attached to body 21 via bolts 26B.

Figure 11:
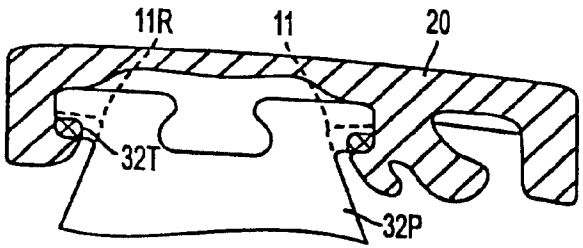
FIG. 11 illustrates the stop tabs according to the present invention.

Referring to FIGS. 3 and 11, bracket 32 may have a portion 32P, which may match the upper profile of beam 11. However, portion 32P may have tabs 32T extending below the rails 11R. Such tabs 32T prevent brackets 20 from being moved beyond the end of beam 11.

Figure 2:
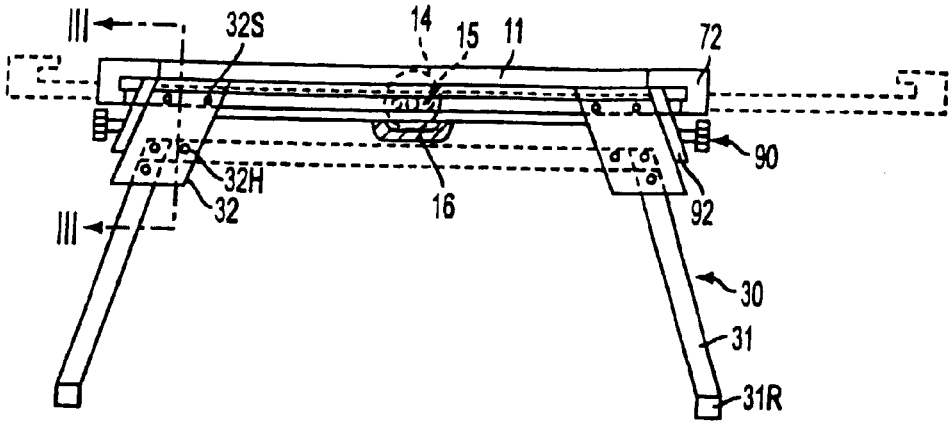
FIG. 2 is a side view of the work bench of FIG. 1.

Referring to FIGS. 1-2, beam 11 may also have a handle 16. Preferably, the handle 16 is bolted onto beam 11. Persons skilled in the art will recognize that handle 16 may be bolted directly onto beam 11, or via a screw/nut assembly in combination with channel 11BC, such as the one used for attaching bracket 33. Persons skilled in the art will recognize that providing handle 16 on the underside of beam 11 will not inconvenience work being conducted on or above beam 11.

Referring to FIGS. 1-3 and 12-14, workbench 10 may have extension arm assemblies 70 on both ends thereof. An extension arm assembly 70 may include an extension arm 71, which telescopes within channel 11C in a retracted position and extends beyond the end of beam 11 in an extended position. Extension arm 71 may be made of a composite material, or a metal, such as steel or aluminum.

An end cap 71C may be disposed at one end of extension arm 71. Preferably, end cap 71C is attached to arm 71 via bolt 71CB. End cap 71C may be made of plastic to facilitate movement of arm 71 along channel 11C. Alternatively, sliding buttons or glides can be disposed instead of end cap 71C. These glides may be made of plastic, such as nylon or UHMW.

Referring to FIGS. 1-3, 12-14 and 18-19, an end cap 72 may be disposed at the other end of arm 71. End cap 72 is preferably made of metal, such as cast aluminum. End cap 72 may be attached to arm 71 via bolt 72B.

Figure 12:
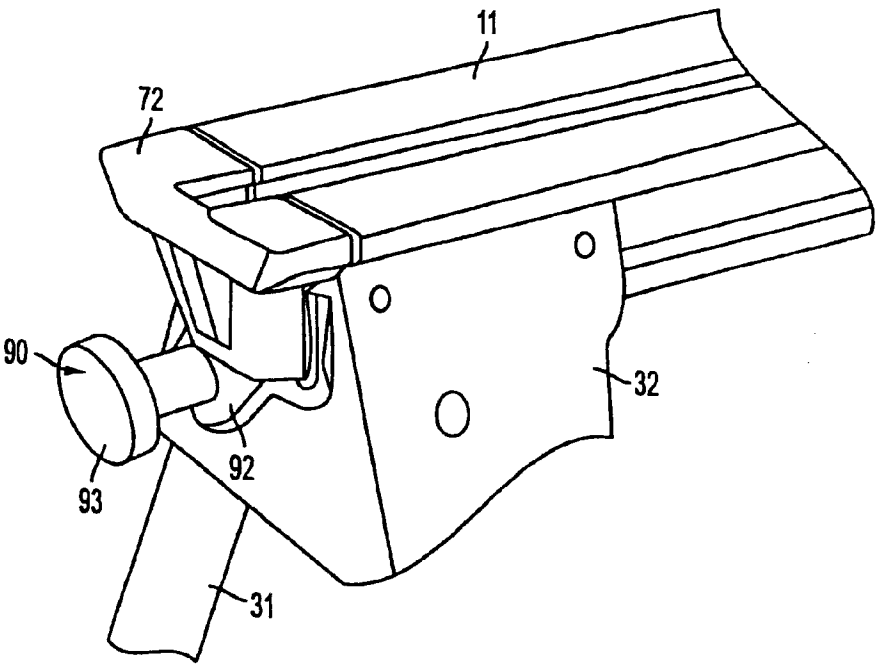
FIG. 12 is a partial perspective view of the assemblies disposed on the end of the portable work bench.
Figure 13:
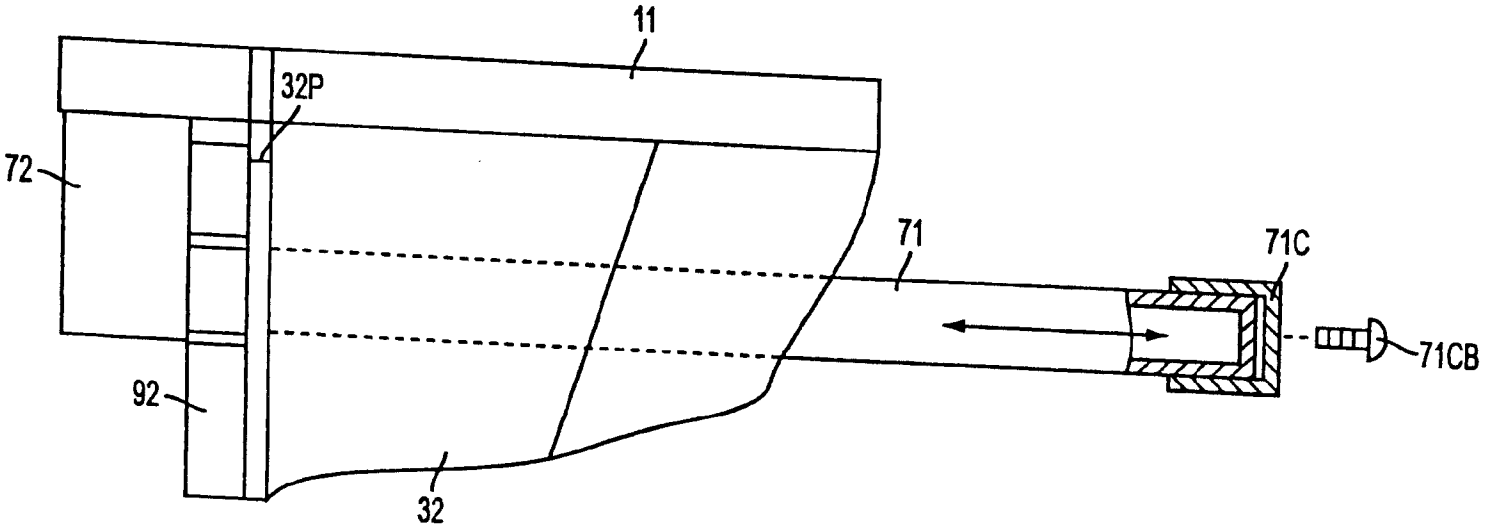
FIG. 13 is a partial side view of the assemblies disposed on the end of the portable work bench.
Figure 14:
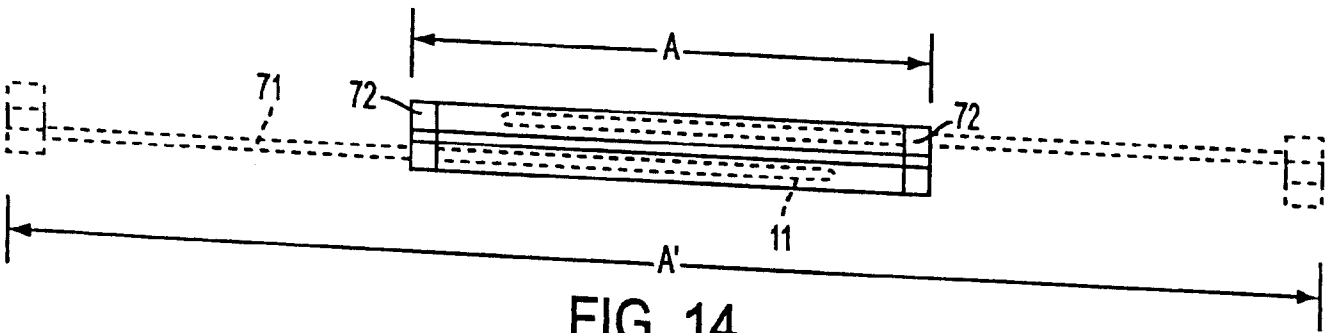
FIG. 14 is a top view of the portable work bench.

Preferably, end cap 72 has upper surfaces 72U which are substantially coplanar to the corresponding upper surfaces of rails 11R. Similarly, end cap 72 may have bottom surfaces 72B which are substantially coplanar with the corresponding surfaces of channel 11TC. This would allow an assembly, such as work support assembly 80 (FIG. 1), which engages upper and bottom surfaces 72U, 72B and channel 11TC when disposed on end cap 72 and beam 11, respectively, to be movable between end cap 72 and beam 11, and vice versa, without removal therefrom when end cap 72 and beam 11 are located adjacent to each other, such as is shown in FIG. 12.

If the combined length of beam 11 and caps 72 (with retracted arms) is A (see FIG. 14), the length of each arm 71 is preferably more than half of length A. Accordingly, when both arms 71 are retracted, a portion of one arm 71 will overlap a portion of the other. However, when both arms 71 are expanded, the total length A' of beam 11 and caps 72 would be at least about twice length A. Persons skilled in the art will recognize that, if the lengths of arms 71 is maximized for maximum length without being longer than beam 11, the total length A' will be between about 2-3 times length A.

Figure 15:
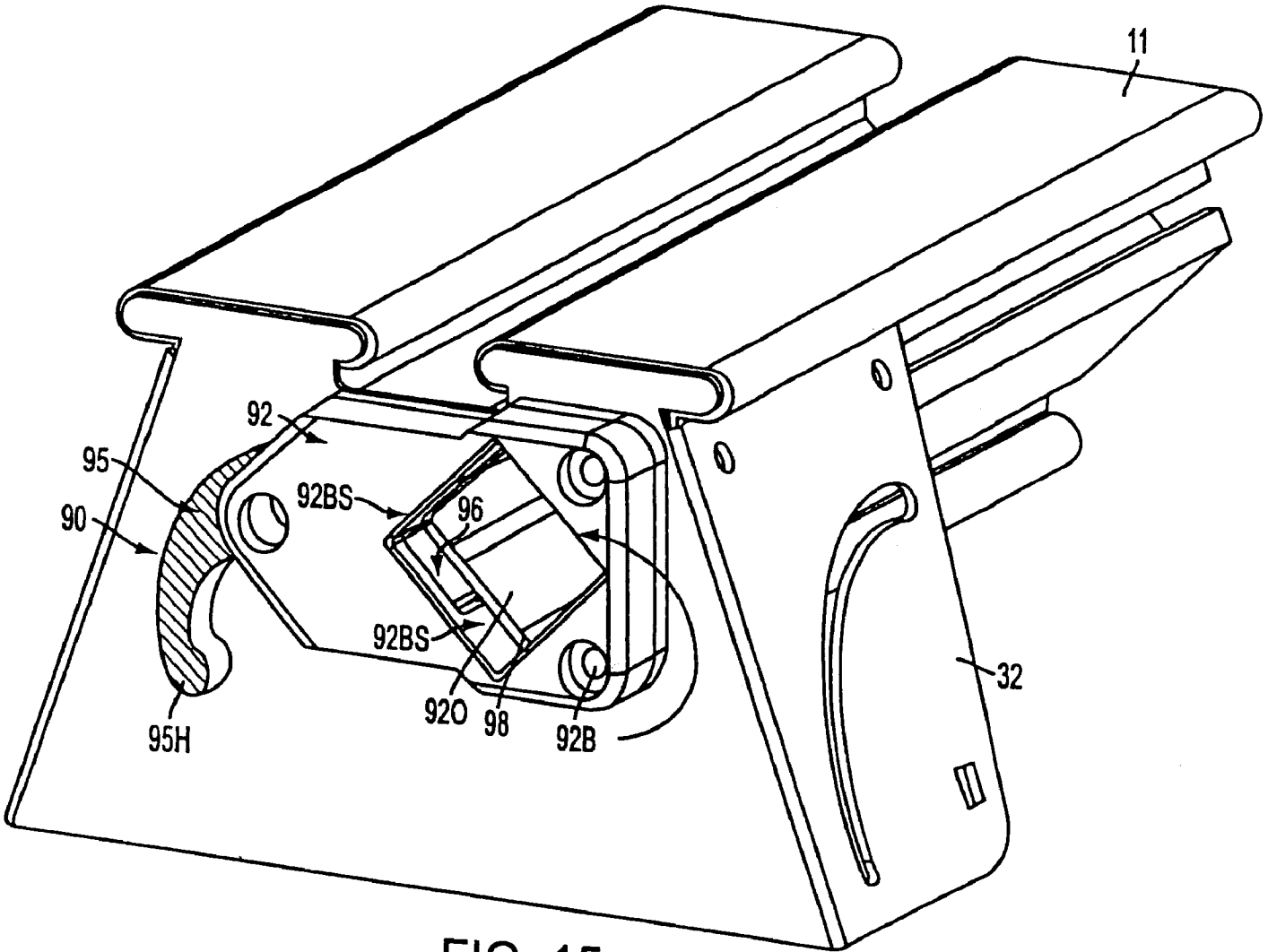
FIG. 15 illustrates a first embodiment of an extension arm lock assembly according to the invention.
Figure 16:
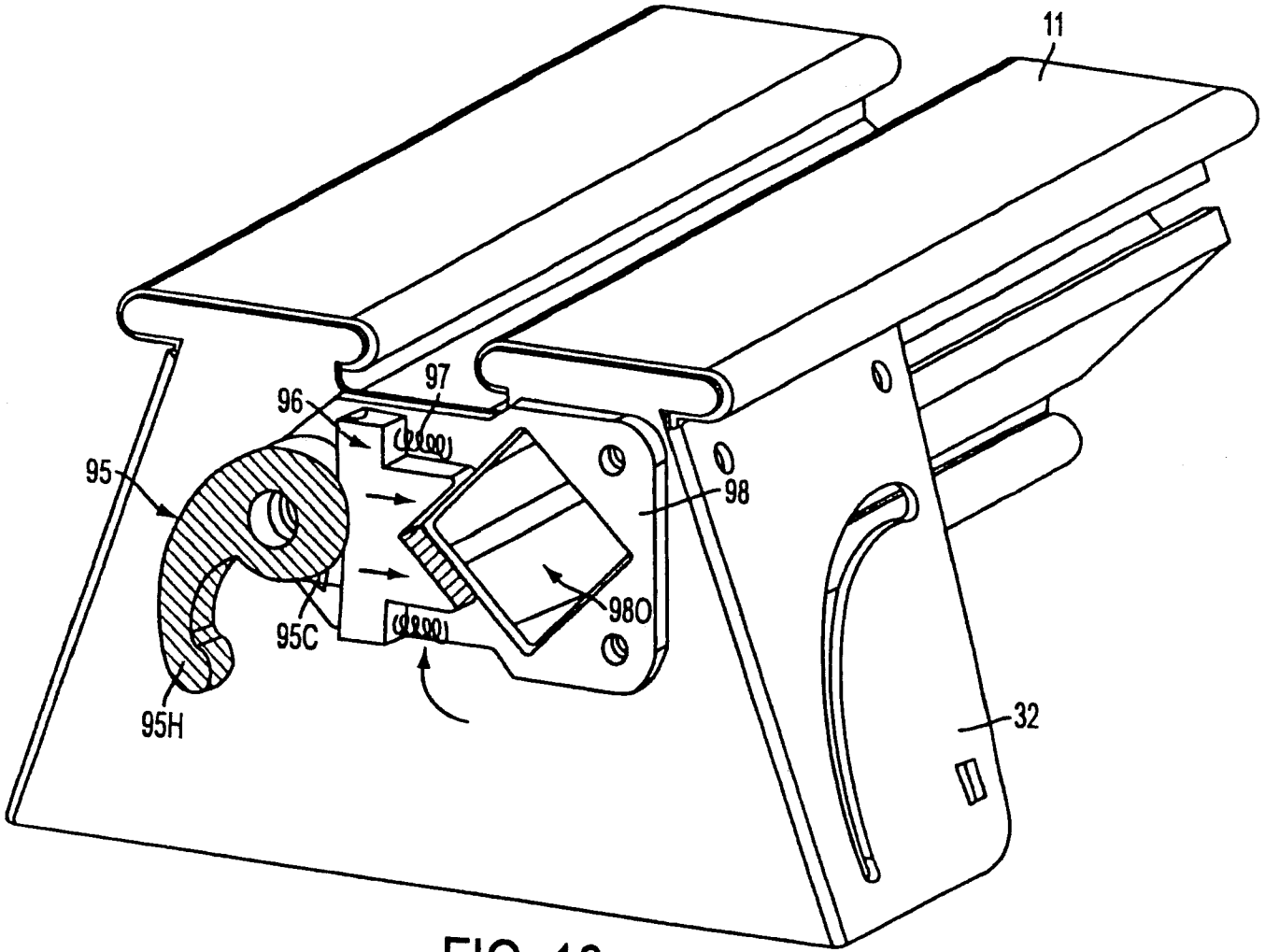
FIG. 16 illustrates the lock assembly of FIG. 15 without a cover.
Figure 17B:
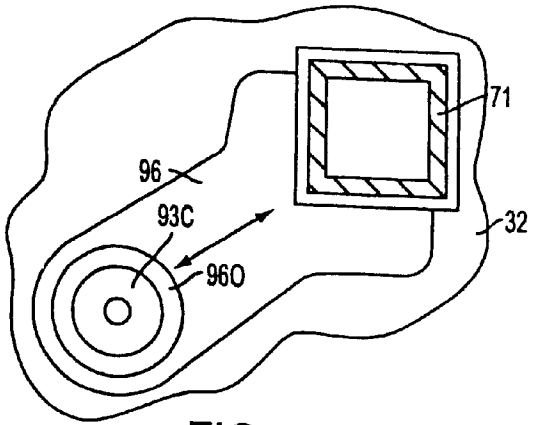
FIGS. 17A-17B show the lock assembly with and without a cover, respectively.
Figure 19:
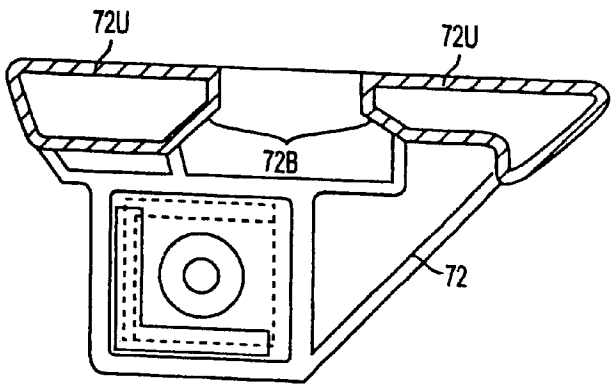
FIG. 19 is a partial cross-sectional view along line XIX-XIX of FIG. 18.
Figure 17A:
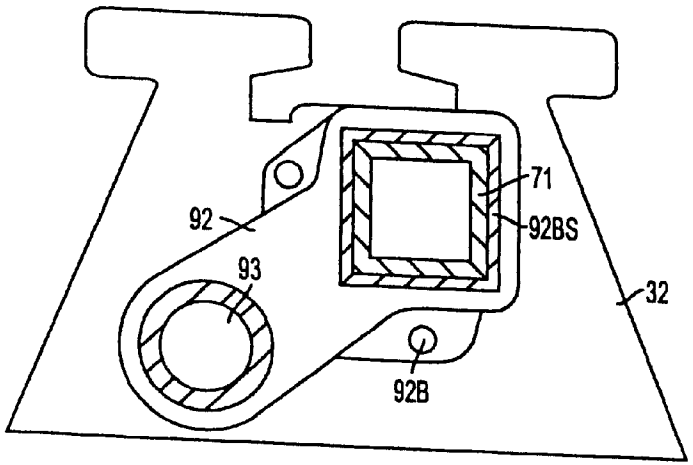
Figure 18:
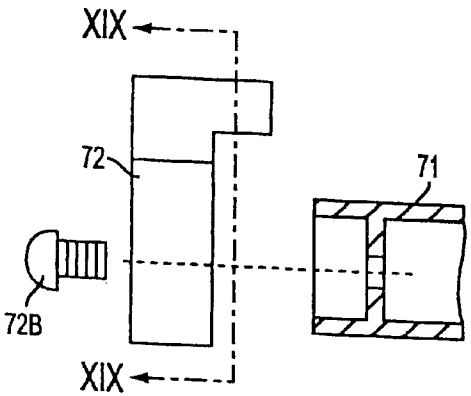
FIG. 18 is an exploded view of an extension arm assembly.

It is desirable to lock arms 71 in any position relative to beam 11. Accordingly, an arm locking mechanism 90 is discussed below. Referring to FIGS. 1-2, 12 and 15-17, arm locking mechanism 90 is preferably disposed on bracket 32. A first embodiment of locking mechanism 90 is shown in FIGS. 15-16, whereas a second embodiment of the mechanism is shown in FIGS. 1-2, 12 and 17.

Referring to FIGS. 15-16, arm locking mechanism 90 may include a housing 92, which is preferably bolted onto bracket 32 via bolts 92B. Housing 92 may be made of plastic, and may have an opening 92O for allowing arm 71 to extend therethrough.

In addition, housing 92 may have bearing surfaces 92BS for supporting arm 71 and facilitating the sliding motion of arm 71 relative to channel 11C (and thus beam 11). Bearing surfaces 92BS are preferably made of plastic or nylon, and can be made integral to housing 92.

A plate 98 may be disposed between bracket 32 and housing 92. Plate 98 may be integral to bracket 32, or it may be a separate piece that is preferably connected to bracket 32 via bolts 92B. Plate 98 may have an opening 98O for allowing arm 71 to extend therethrough.

A cam 95 may be captured between plate 98 and housing 92. Preferably, cam 95 is pivotally connected to housing 92 and/or plate 98 to allow rotation of cam 95 about an axis substantially parallel to the longitudinal axis of beam 11. Cam 95 may have a handle 95H to enable the user to rotate cam 95.

Cam 95 may have a cam surface 95C which contacts a sliding lock 96. Lock 96 is preferably captured between plate 98 and housing so that it can slide towards and away from cam 95. Lock 96 may be made of plastic or rubber. Springs 97 may be disposed between lock 96 and plate 98 and/or housing 97 to bias lock 96 towards cam 95.

With such arrangement, the user can lock arm 71 at a desired position by rotating cam handle 95H. As handle 95H is rotated, cam 95 (and thus cam surface 95C) is rotated, pushing lock 96 towards openings 92O, 98O (and thus towards arm 71), locking arm 71 in place. To unlock arm 71, the user needs only to move handle 95H in the opposite direction, releasing the camming force, and allowing springs 97 to move lock 96 away from arm 71.

FIGS. 1-2, 12 and 17 illustrate the second embodiment of arm locking mechanism 90, where like numerals refer to like parts. All the teachings of the first embodiment are incorporated herein by reference. Unlike in the first embodiment, the user rotates a knob 93, which is connected to bracket 32. Knob 93 may have an eccentric cam surface 93C, which is received within an opening 96O in lock 96.

Accordingly, when the user rotates knob 93, cam surface 93C is rotated, causing a translational movement of lock 96, thus locking arm 71 in place. To unlock, the user need only rotate knob 93 in the opposite direction. The second embodiment has the advantage that, since cam surface 93C is captured within opening 96O, springs 97 are not necessary. This is because the interaction between cam surface 93C and opening 96O retracts lock 96.

Figure 20A:
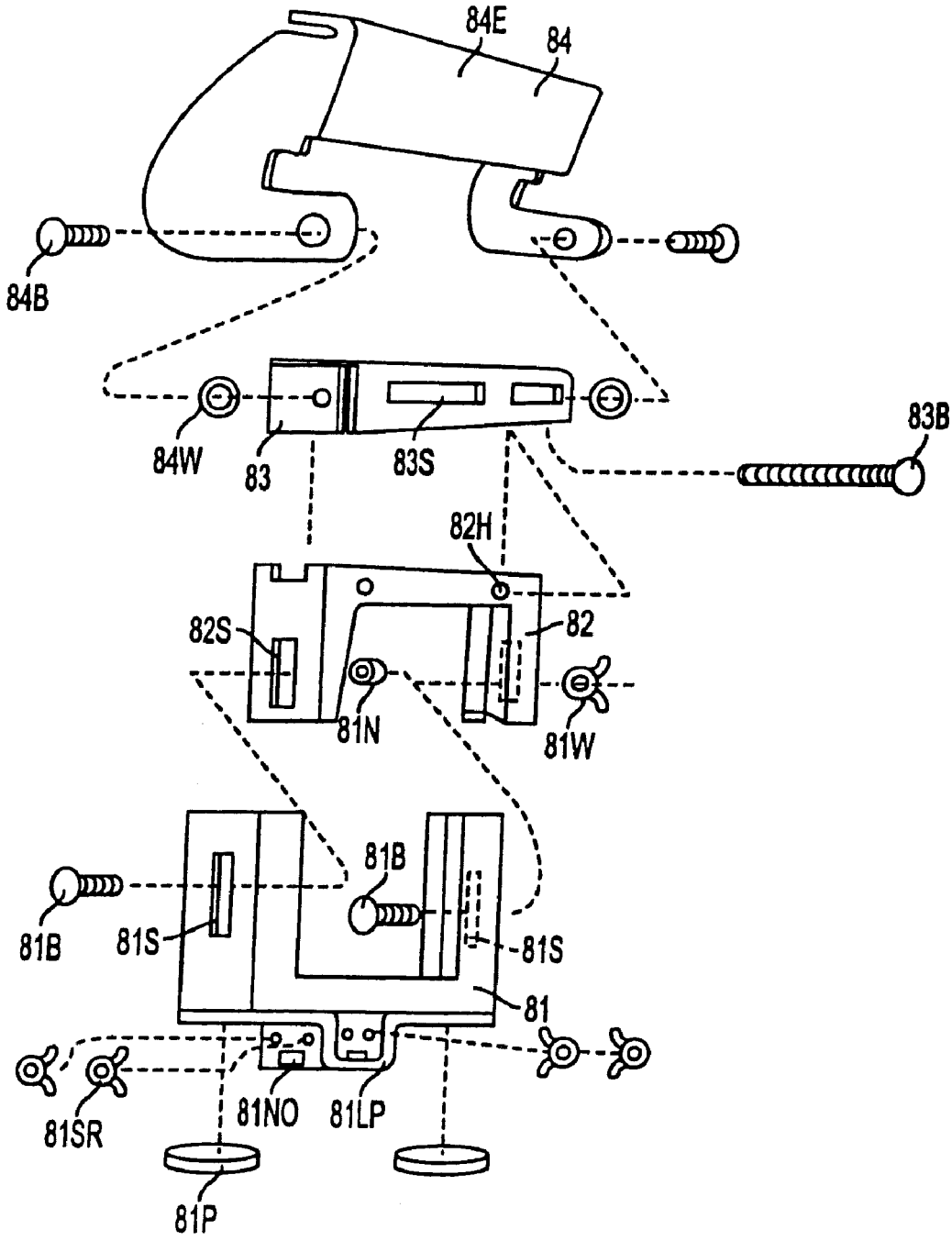
FIGS. 20A, 20B and 20C are exploded, front and side views of the assembly, respectively.

Referring to FIG. 20, a work support assembly 80 may be provided on end cap 78 and/or beam 11. As discussed above, work support assembly 80 may engage upper and bottom surfaces 72U, 72B and channel 11TC when disposed on end cap 72 and beam 11, respectively. This would allow work support assembly 80 to be movable between end cap 72 and beam 11, and vice versa, without removal therefrom when end cap 72 and beam 11 are located adjacent to each other, such as is shown in FIG. 12.

Work support assembly 80 may include a lower body 81, which may be made of bent sheet metal, such as steel. Lower body 81 may have at least one slot 81S, which is preferably substantially vertical. Lower body 81 may slidingly receive middle body 82, which may also be made of bent sheet metal, such as steel. Middle body 82 may also have at least one slot 82S, which is preferably substantially vertical and/or aligned with slot 81S.

The lower and middle bodies 81,82 may be held in place relative to each other by screws 81B, which extend through slots 81S, 82S and engage a nut 81N or wingnut 81W on the other side. Persons skilled in the art will recognize that such construction will allow a user to move lower and middle bodies 81,82 vertically relative to each other.

An upper body 83 is preferably disposed on middle body 82. Upper body 83 may be made of bent sheet metal, such as steel. Upper body 83 may have slots 83S, which are preferably substantially horizontal. Middle and upper bodies 82,83 may be held in place relative to each other by screws 83B, which extend through slots 83S and holes 82H on middle body 82. Screws 83B may be held in place by nuts (not shown), which may be integral to middle body 82 or upper body 83, or may be separate therefrom.

Upper body 83 may have an upper support surface 83SS for supporting a workpiece. Preferably, support surface 83SS is substantially horizontal.

An end stop 84 may be pivotally attached to upper body 83. Preferably, screws 84B extend through stop 84, washers 84W (which may be made of nylon, plastic or metal), and upper body 83, and threadingly engage nuts (not shown).

End stop 84 may have a substantially planar surface 84E. Surface 84E may be pivoted between first and second positions. In the first position, surface 84E will preferably be substantially vertical. In addition, surface 84E may face the power tool 100, so that it can contact the workpiece and act as an end stop. In the second position (shown in broken lines in FIG. 20C), surface 84E is below support surface 83SS (and thus below the workpiece). In other words, surface 84E is effectively bypassed, so that the workpiece contacts only support surface 83SS.

Persons skilled in the art will recognize that, with the arrangement described above, support surface 83SS and/or surface 84E can be adjusted vertically and/or horizontally.

As mentioned above, work support assembly 80 may be disposed in channel 11TC of beam 11. Accordingly, it is preferable to provide assembly 80 with the means for attachment thereon. Lower body 81 may have a lower plate 81LP fixedly attached to lower body 81. Lower plate 81LP may be welded or riveted to lower body 81. Lower plate 81LP and/or lower body 81 may carry sliding pads 81P and/or sliding rivets 81SR for facilitating sliding of lower plate 81LP and/or lower body 81 along beam 11. Preferably, sliding pads 81P and/or sliding rivets 81SR are made of plastic, nylon, UHMW, etc.

Lower body 81 may carry a screw, which extends into a cavity 81PC formed by lower plate 81LP, and threadingly engage a retaining nut 85N. Nut 85N may have flanges 85NF, which may extend through openings 81NO and contact the underside of rails 11R. Such screw may be a standard screw or thumbscrew. Accordingly, the user can rotate the screw, moving nut 85N (and flanges 85NF) upwardly into contact with the underside of rails 11R, thus locking support assembly 80 in place.

Figure 20B:
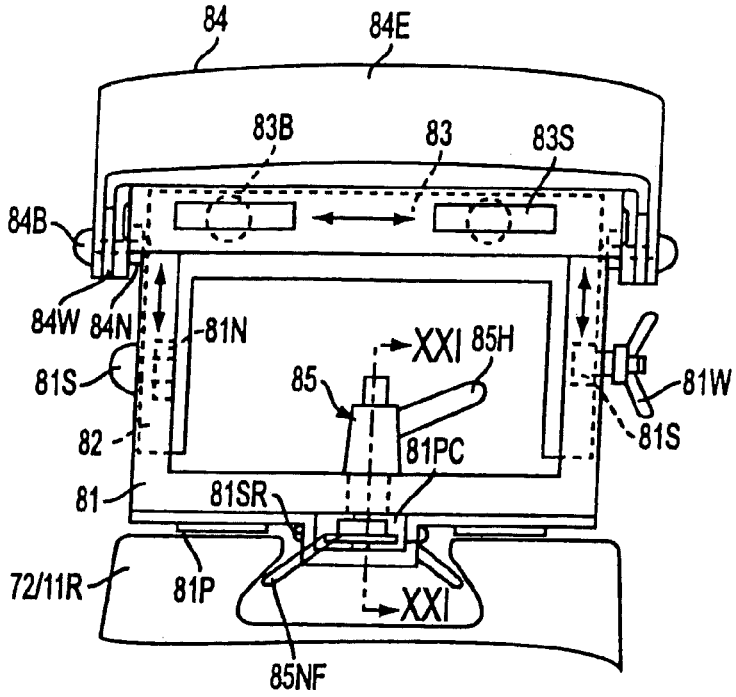
Figure 20C:
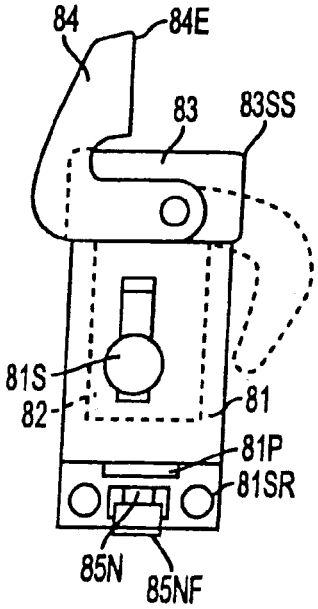
Figure 21:
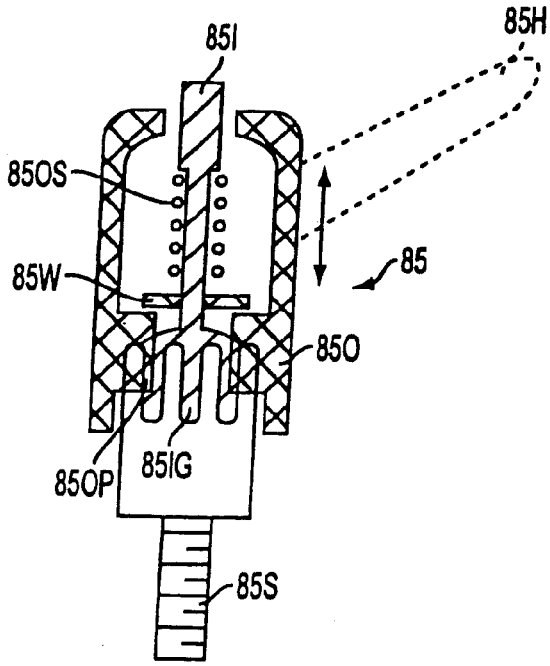
FIG. 21 is a cross-sectional view along line XXI-XXI of FIG. 20B.

Alternatively, such screw may be an adjustable screw assembly 85, as shown in FIGS. 20B and 21. Adjustable screw assembly 85 may have a lower screw 85S for threadingly engaging nut 85N and an inner pistil 85I fixedly connected to screw 85S. Pistil 85I may be molded over screw 85S. Pistil 85 may have outer grooves 85IG formed thereon.

In addition, an outer shell 85O may be slidably disposed on pistil 85I. Outer shell 85O preferably slides relative to pistil 85I. Outer shell 85O may have protrusions 85OP which engage the grooves 85IG, for fixing the axial location of outer shell 85O relative to pistil 85I. Outer shell 85O may also have a handle for rotating outer shell 85O with or without pistil 85I.

A spring 85OS may be disposed between pistil 85I and a washer 85W and/or outer shell 85O for biasing the outer shell 85O downwardly. In other words, spring 85OS may bias protrusions 85OP into engagement with grooves 85IG.

With such construction, the user may rotate screw assembly 85, moving nut 85N (and flanges 85NF) upwardly into contact with the underside of rails 11R, thus locking support assembly 80 in place. If the user wants to adjust the axial position of handle 85H to obtain better leverage, the user needs to lift handle 85H and/or outer shell 85O, rotate outer shell 85O relative to pistil 85I, and release outer shell 85O. Spring 85OS will then push outer shell 85O back into engagement with grooves 85IG of pistil 85I.

Persons skilled in the art may recognize other additions or alternatives to the means disclosed herein. However, all these additions and/or alterations are considered to be equivalents of the present invention.

The invention claimed is:

1. A work bench comprising:

a beam having first and second sides;

legs for supporting the beam;

at least one bracket for supporting a tool, the bracket having first and second surfaces for contacting the first and second sides of the beam, respectively, the second surface being movable between a first position contacting the second side of the beam, and a second position not contacting the second side of the beam;

a spring biasing the second surface towards the first position, the spring providing a non-locking force that allows an operator to slide the bracket along the beam; and a locating mechanism disposed on the beam for fixing the position of the bracket on the beam.

2. The work bench of claim 1, wherein the spring is disposed on the bracket.

3. The work bench of claim 1, wherein the beam is tubular.

4. The work bench of claim 3, wherein the beam is made of aluminum.

5. The work bench of claim 1, wherein the legs are pivotable relative to the beam between opened and closed positions.

6. The work bench of claim 5, wherein at least one of the legs comprises a detent mechanism for maintaining the at least one leg in at least one of the opened and closed positions.

7. The work bench of claim 1, wherein at least one of the first and second surfaces are made of plastic.

8. The work bench of claim 1, wherein the locating mechanism comprises a clip disposed on the beam.

9. The work bench of claim 1, wherein the bracket has feet for disposing the bracket on a substantially horizontal surface.

10. The work bench of claim 9, wherein the feet are made of rubber or an elastomeric material.

11. The work bench of claim 1, further comprising a handle attached to the beam.

12. The work bench of claim 11, wherein the handle is attached to the underside of the beam.

13. The work bench of claim 1, further comprising at least one extension arm slidably disposed within the beam.

* * * * *